US005694002A

United States Patent [19]

Krasko et al.

[11] Patent Number: 5,694,002

[45] Date of Patent: Dec. 2, 1997

[54] METAL HALIDE LAMP WITH IMPROVED COLOR CHARACTERISTICS

[75] Inventors: Zeya K. Krasko, Peabody; Nanu Brates, Malden, both of Mass.

[73] Assignee: Osram Sylvania Inc., Danvers, Mass.

[21] Appl. No.: 690,957

[22] Filed: Aug. 1, 1996

Related U.S. Application Data

[60] Provisional application No. 60/017,426 May 8, 1996.

[51] Int. Cl.[6] ..... H01J 61/22

[52] U.S. Cl. ..... 313/641; 313/571; 313/25

[58] Field of Search ..... 313/25, 639, 640, 313/641, 642, 638, 571; 445/26

[56] References Cited

U.S. PATENT DOCUMENTS

| | | | |
|---|---|---|---|
| 4,557,700 | 12/1985 | Rothwell, Jr. et al. | 445/26 |
| 4,581,557 | 4/1986 | Johnson | 313/25 |
| 5,013,968 | 5/1991 | Russell et al. | 313/641 |
| 5,057,743 | 10/1991 | Krasko et al. | 313/639 |
| 5,144,201 | 9/1992 | Graham et al. | 313/634 |
| 5,363,007 | 11/1994 | Fromm et al. | 313/25 |

*Primary Examiner*—Michael Horabik
*Assistant Examiner*—Michael Day
*Attorney, Agent, or Firm*—William H. McNeill

[57] ABSTRACT

A highly efficient discharge lamp has a color rendering index of about 85, a lumens per watt rating of about than 90, a correlated color temperature of 3000° K., and a wall loading of about 21 W/cm$^2$. The lamp has an outer glass envelope and a pair of electrical conductors extending into the interior of the glass envelope; a quartz discharge tube disposed within the outer envelope and including a pair of spaced electrodes which are electrically connected to the electrical conductors for creating an electrical discharge during operation of the lamp, the discharge tube having an arc chamber. An arc generating and sustaining medium is provided within the arc chamber and includes the halides of sodium, scandium, lithium, dysprosium and thallium, a fill gas selected from argon and xenon, and a given quantity of mercury to achieve a desired lamp voltage. In a preferred embodiment of the invention the halides are iodides and are present in the mole ratio of about 24–44:1:9.5:>3<4, while the thallium is present in an amount of about 0.35 to 0.45 mg/cm$^3$ of arc tube volume.

3 Claims, 2 Drawing Sheets

METAL HALIDE LAMP WITH IMPROVED COLOR CHARACTERISTICS

RELATED APPLICATIONS

This application claims the Benefit of U.S. Provisional Application No. 60/017,426, filed May 5, 1996.

TECHNICAL FIELD

This invention relates to metal halide arc discharge lamps and more particularly to such lamps having a correlated color temperature (CCT) of about 3000° K., a color rendering index (CRI) of about 85, together with improved color consistency from lamp to lamp and reduced sensitivity of the lamp performance to its orientation.

BACKGROUND ART

Metal halide lamps of intermediate to high wattage, i.e., 175 to 1500 watts, were introduced in the U.S. in the early 1960's. They provided high efficacy, a CCT of about 4000° K. and a CRI of about 65, numbers which meet most commercial needs. These lamps employed, typically, a sodium iodide, scandium iodide fill (occasionally also employing cesium) at a reasonably high power loading of 12 w/cm$^2$ of inner arc tube surface.

As the market need for lower lamp wattages developed, 50, 70, 100 and 150 watt sizes having a warm color temperature of about 3000° K. and a CRI of about 75 were introduced. These results were achieved by the addition of lithium iodide to the sodium-scandium-mercury-inert gas fill of the prior art. See, for example, U.S. Pat. No. 5,057,743, which is assigned to the assignee of this invention. While these lamps function well, the output radiation has a purplish tint which is reflected in a shift of color chromaticity coordinates from the black body at 3200° K. (x=0.420, y=0.395) down to x=0.420, y=0.380. This color shift has occasionally been found to be objectionable. Moreover, the specific color rendering index No. 9 (deep red) has a low negative value of –65.

Additionally, such lamps have been found to provide a great variation in color temperature depending on the lamp operating orientation, i.e., whether vertical or horizontal.

DISCLOSURE OF INVENTION

It is, therefore, an object of the invention to obviate the disadvantages of the prior art.

It is another object of the invention to enhance the operation of arc discharge lamps.

These objects are accomplished, in one aspect of the invention, by the provision of a highly efficient discharge lamp having a color rendering index of about 85, a lumens per watt rating of about 90, a correlated color temperature of 3000° K., and a wall loading of about 21 W/cm$^2$. The lamp comprises an outer glass envelope having a pair of electrical conductors extending into the interior of the glass envelope. A quartz discharge tube is disposed within the outer envelope and includes a pair of spaced electrodes which are electrically connected to the electrical conductors for creating an electrical discharge during operation of the lamp. The discharge tube has an arc chamber and an are generating and sustaining medium within the arc chamber which comprises the halides of sodium, scandium, lithium, dysprosium and thallium, a fill gas selected from argon and xenon, and a given quantity of mercury to achieve a desired lamp voltage. In addition to the scandium iodide, a small amount of scandium metal may be included.

Lamps of such construction are remarkably uniform in color temperature regardless of orientation and have a much more uniform wall temperature when operated vertically in vacuum outer jackets.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
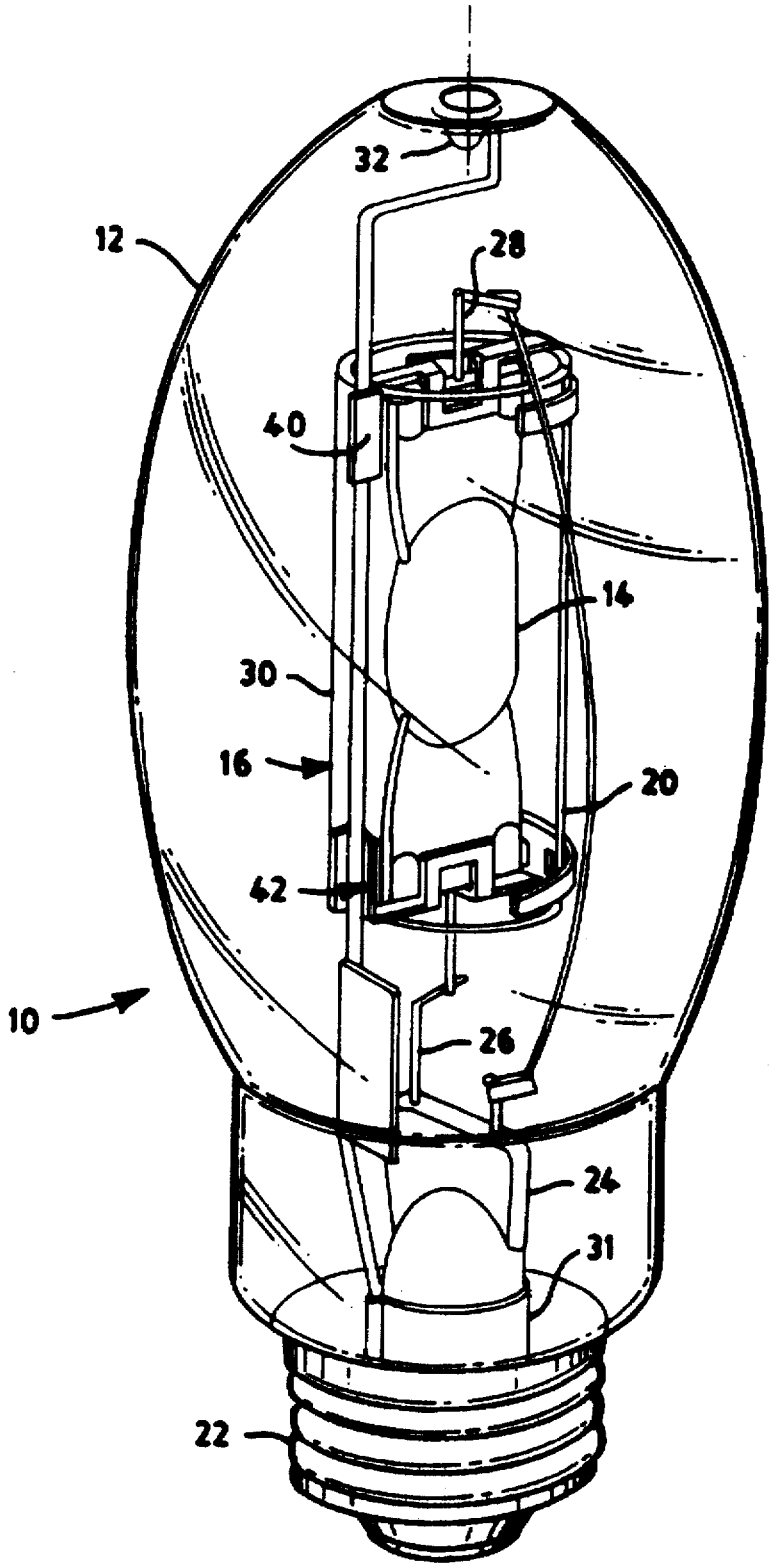
FIG. 1 is a perspective view of a typical high intensity arc discharge lamp which can employ the invention.

Referring now to the drawings with greater particularity, there is shown in FIG. 1 a metal halide arc discharge lamp 10 including a lamp envelope 12 and an arc tube 14 mounted within the envelope by mounting frame 16. The arc tube 14 has an arc chamber which has a volume of about 1.2 cm$^3$; and an arc length of about 1.0 cm. The are tube may be positioned within a shroud 20 which can also be supported by the mounting frame 16. Electrical energy is coupled to the are tube 14 through a base 22, a lamp stem 24 and electrical leads 26 and 28. The arc tube contains a chemical fill or dose of materials to provide light when an arc is initiated therein, as will be explained hereinafter. The shroud 20 comprises a cylindrical tube of light transmissive, heat resistant material such as quartz.

As noted, in this particular instance, the mounting frame 16 supports both the arc tube and the shroud within the lamp envelope 12. The mounting frame 16 includes a metal support rod 30 attached to lamp stem 24 by a strap 31. The support rod engages an inward projection 32 in the upper end of the lamp envelope 12. The support rod 30 in its central portion is parallel to a central axis of the arc tube 14 and shroud 20. The mounting means 16 further includes an upper clip 40 and a lower clip 42 which secure both are tube 14 and shroud 20 to support rod 30. The clips 40 and 42 are attached to the support rod 30, preferably by welding.

The objects of the invention are especially achieved by a new metal halide composition which is comprised of the iodides of sodium, scandium, lithium, dysprosium and thallium. When dosed into a quartz arc tube which is then operated at power loadings which would be considered excessive for prior art chemistries, unexpected advantages follow.

For example, when the five component chemistry is dosed into a standard 75 watt quartz tube which is then operated at 100 watts, thereby increasing the power loading from the conventional 15.5 W/cm$^2$ to 21 W/cm$^2$ the performance of the lamp is unexpectedly improved in many aspects, while no detrimental effects from the elevated loading are found.

Table I below illustrates a comparison of 100 watt lamps utilizing a prior art chemical composition of sodium, scandium and lithium iodides (tricomponent) with the five component mix of the invention.

TABLE I

| CHEM. FILL | W/cm² | LPW | CCT | CRI |
|---|---|---|---|---|
| Tricomponent | 15.5 | 85 | 3000 | 75 |
| Fivecomponent | 21.0 | 90 | 3000 | 85 |

It can be seen that the lamps with the five component chemistry and elevated wall loading have higher luminous efficacy and higher general color index than lamps of the prior art, while still maintaining "warm" color temperature of 3000° K., which is very desirable for interior illumination.

Additionally, and unexpectedly, lamps containing the five component chemistry with the substantially higher wall loading, exhibit a maximum temperature in the upper part of the arc tube, operated vertically in vacuum outer jacket, of only 50° C. higher than in the prior art lamp. This fact is beneficial for maintaining life expectancy comparable to the prior art lamps, i.e., 15,000 hours.

These results are tabulated in Table II.

TABLE II (WALL TEMPERATURE OF ARC TUBE OPERATING VERTICALLY IN VACUUM OUTER JACKET)

| Location on arc tube wall | Tricomp. | Fivecomp. | dT |
|---|---|---|---|
| Top, °C. | 865 | 915 | 50 |
| Bottom, °C. | 810 | 920 | 110 |

This relatively uniform wall temperature distribution also has an advantage in providing universal lamp operation in different lamp orientations, as exemplified in Table III.

TABLE III (COLOR TEMPERATURE OF 100W LAMPS VS. LAMP ORIENTATION)

| Lamp orientation | Tricomp. | Fivecomp. |
|---|---|---|
| Vertical, CCT | 3000° K. | 3000° K. |
| Horizontal, CCT | 3650° K. | 3150° K. |
| Difference | 650° K. | 150° K. |

Yet another unexpected advantage of the five component lamp relative to the prior art is the much better lamp-to-lamp color uniformity. While the exact reason for this is not known, it is possibly attributed to the more uniform color temperature distribution and higher salt temperature. Typically, for a group of 10 lamps of the five component chemistry, the CCT spread is less than 100. This is about one half of the typical CCT spread of lamps utilizing the hi-component chemistry of the prior art.

Yet another advantage of the five component system appears as improved radiation color with chromaticity coordinate position right on the black body locus, providing very favorable color rendering without any color tint of white surfaces. This is in contrast to the hi -component of the prior art whose chromaticity coordinates located below the black body locus had provided purplish tint.

Figure 2:
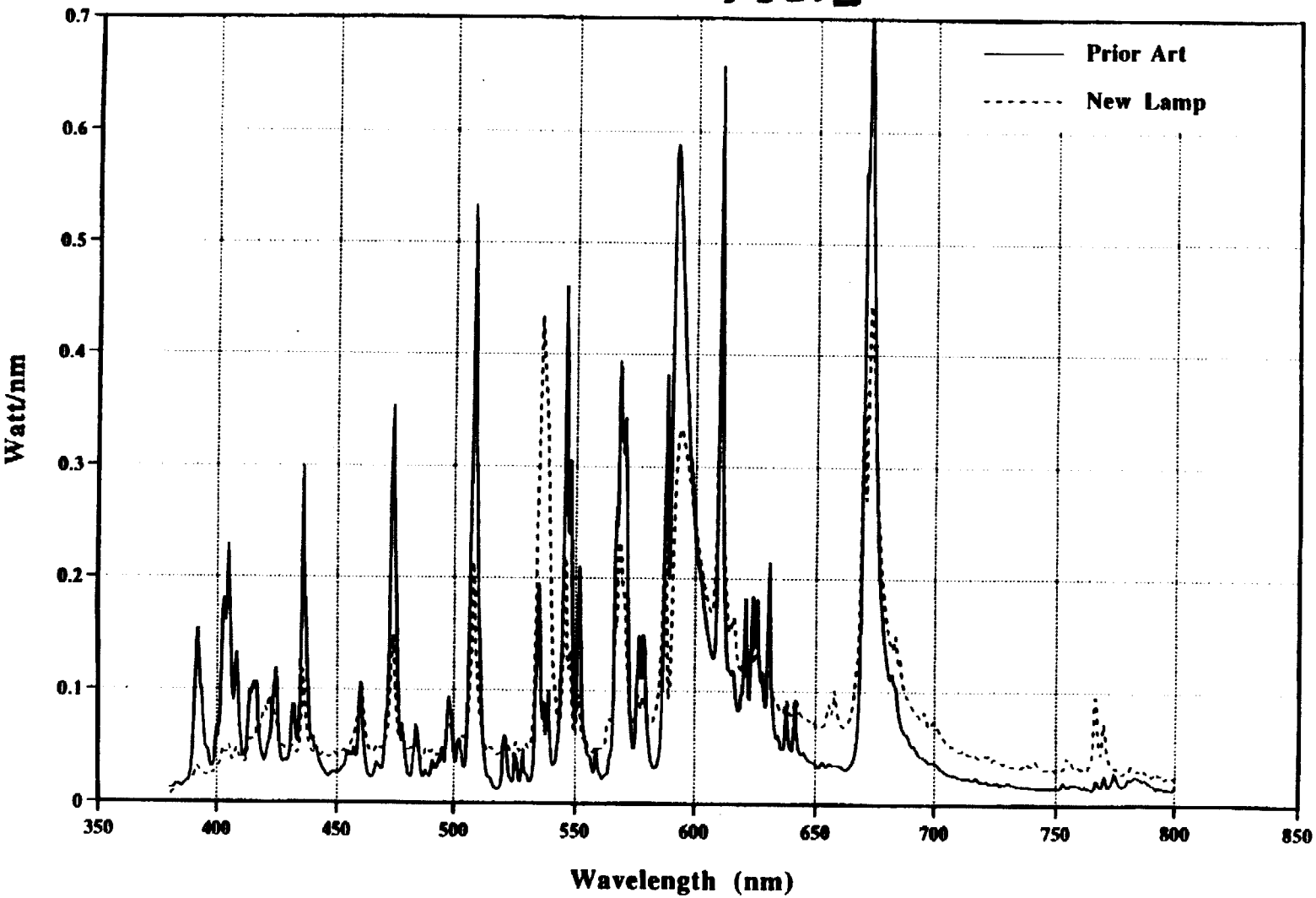
FIG. 2 is a graphical comparison of the light output of a prior art lamp and the lamp of the invention.

This is exemplified by FIG. 2 which shows a comparison of the spectra of the tricomponent and five component chemistries. The increase in the background radiation is apparent across the entire visible region, but especially so in the red portion of the spectrum. This resulted in the increased values of a general color rendering index from CRI=75 and of a deep red color index R=−65 for the prior art lamps to a CRI of 85 and an R9=−15 for the five component chemistry.

In the preferred embodiments of the invention, these results are achieved when the mole fractions of the iodides of sodium, scandium, lithium and dysprosium are about 24-44:1:9.5: more that 3 and less than 4, and the thallium is added in amount of about 0.35 to 0.45 mg/cm³ of arc tube volume. The thallium is preferably added as an amalgam. In lamps having the characteristics described herein, the fill will contain 15 mg of mercury.

The most preferred embodiment occurs when the mole fraction of sodium is 44 and the mole fraction of dysprosium is 3.5. Lesser amounts of sodium tend to decrease the LPW somewhat.

Amounts of dysprosium less than 3 have not been to seen provide any benefits while amounts greater than about 4 result in an undesirable increase in the CCT.

The amount of thallium addition is critical since amounts greater than about 0.45 mg/cm³ result in a greenish tint and lower LPW, and amounts less than 0.35 mg/cm³ produce an undesirable purplish tint. Employing the proportions given herein with the proper amount of thallium provides a lamp with a warm white color chromaticity coordinates of x=0.420, y=0.395, very close to the black body locus.

While there have been shown and described what are at present considered the preferred embodiments of the invention, it will be apparent to those skilled in the art that various changes and modifications can be made herein without departing from the scope of the invention as defined by the appended claims.

What is claimed is:

1. A highly efficient discharge lamp having a color rendering index of about 85, a lumens per watt rating of about 90, a correlated color temperature of 3000° K., and a wall loading of about 21 W/cm², comprising:

an outer glass envelope and a pair of electrical conductors extending into the interior of the glass envelope;

a quartz discharge tube disposed within the outer envelope and including a pair of spaced electrodes which are electrically connected to the electrical conductors for creating an electrical discharge during operation of the lamp, the discharge tube having an arc chamber; and an arc generating and sustaining medium within the arc chamber comprising the iodides of sodium, scandium, lithium, dysprosium and thallium, wherein said sodium, scandium, lithium and dysprosium are present in the mole ratio of about 24–44:1:9.5:>3<4, and said thallium is present in an amount from more than 0.35 mg to less than 0.45 mg per cm³ of are chamber volume, a fill gas selected from argon and xenon, and mercury in an amount of 15 mg to achieve a desired lamp voltage.

2. The lamp of claim 1 wherein the sodium, scandium, lithium, dysprosium are present in the mole ratio of 44:1:9.5:>3<4.

3. The lamp of claim 2 wherein the amount of dysprosium is present in the mole ratio of 3.5.

* * * * *

Disclaimer 5,694,002—Zeya K. Krasko, Peabody; Nanu Brates, Malden, both of Mass. METAL HALIDE LAMP WITH IMPROVED COLOR CHARACTERISTICS. Patent dated December 2, 1997. Disclaimer filed March 5, 1998, by the assignee, Osram Sylvania, Inc.

Hereby enters this disclaimer to claims 1, 2 and 3 of said patent.

(*Official Gazette,* June 2, 1998)